US011305442B2

(12) United States Patent
Sinkevich

(10) Patent No.: US 11,305,442 B2
(45) Date of Patent: Apr. 19, 2022

(54) MULTIFUNCTION FOLDABLE KNIFE

(71) Applicant: Dmitry Sinkevich, Sherman Oaks, CA (US)

(72) Inventor: Dmitry Sinkevich, Sherman Oaks, CA (US)

( * ) Notice: Subject to any disclaimer, the term of this patent is extended or adjusted under 35 U.S.C. 154(b) by 494 days.

(21) Appl. No.: 16/149,133

(22) Filed: Oct. 2, 2018

(65) Prior Publication Data

US 2020/0070372 A1 Mar. 5, 2020

Related U.S. Application Data

(60) Provisional application No. 62/727,428, filed on Sep. 5, 2018.

(51) Int. Cl.

| | |
|---|---|
| ***B26B 11/00*** | (2006.01) |
| ***B67B 7/40*** | (2006.01) |
| ***B25F 1/04*** | (2006.01) |
| ***B25B 15/00*** | (2006.01) |

(52) U.S. Cl.

CPC ..... *B26B 11/006* (2013.01); *B25F 1/04* (2013.01); *B67B 7/403* (2013.01); *B25B 15/007* (2013.01)

(58) Field of Classification Search

CPC ..... B26B 11/0006; B25F 1/04; B67B 7/403; B25B 15/007

USPC ..... 7/161; 30/161

See application file for complete search history.

(56) References Cited

U.S. PATENT DOCUMENTS

| | | | | |
|---|---|---|---|---|
| 1,357,398 | A * | 11/1920 | Haywood | B26B 1/046 30/161 |
| 1,834,266 | A * | 12/1931 | Bohner | B25F 1/00 7/167 |
| 6,112,352 | A * | 9/2000 | Legg | B26B 11/008 7/118 |
| 7,000,323 | B1 * | 2/2006 | Hatcher | B26B 1/046 30/155 |
| 8,893,389 | B2 * | 11/2014 | Freeman | B26B 1/046 30/155 |
| 2010/0275447 | A1 * | 11/2010 | Perreault | B26B 1/046 30/161 |

* cited by examiner

*Primary Examiner* — Hadi Shakeri
(74) *Attorney, Agent, or Firm* — Loza & Loza, LLP; Heidi Eisenhut

(57) ABSTRACT

A knife is disclosed having a handle with first and second half handles, a blade containing portion for securing a blade and an opening in a top surface of handle and first and second ends to contain the blade in a folded closed position. The knife includes a hook portion on a posterior end of the blade and a cutting surface portion on an anterior end; a nut and bolt system passing through the blade near the posterior end and both half handles terminating at on outside portion of each half handle enabling the blade to rotate between open and closed positions. A spring bar is integrated in a central portion of the first half handle, attached to the first half handle at a posterior end and including a ball pin on an anterior end of the spring bar, the ball pin enabled to engage the blade in various positions.

19 Claims, 7 Drawing Sheets

FIG. 3
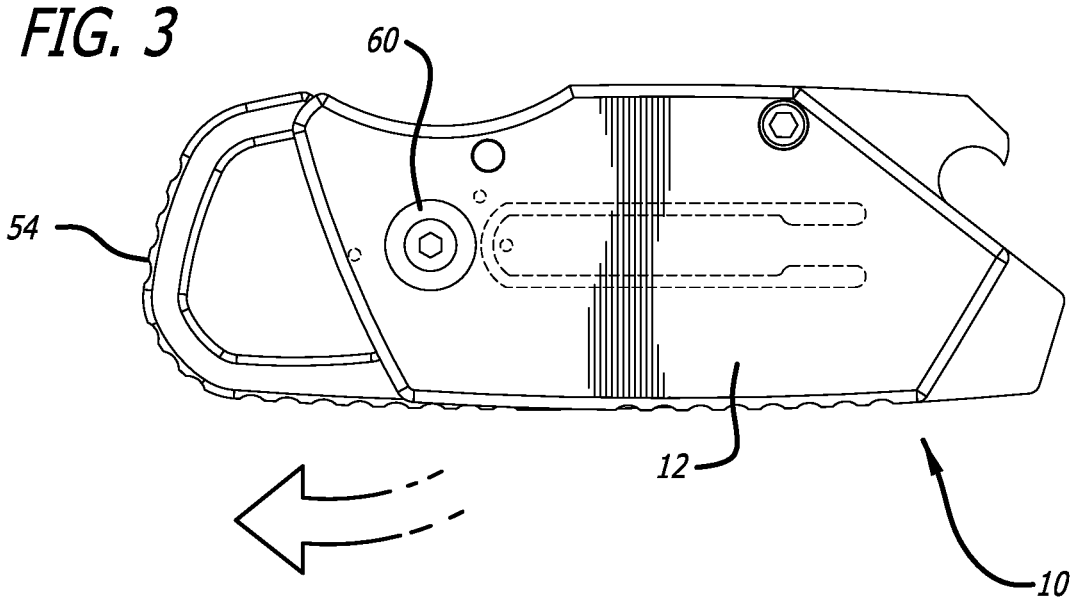
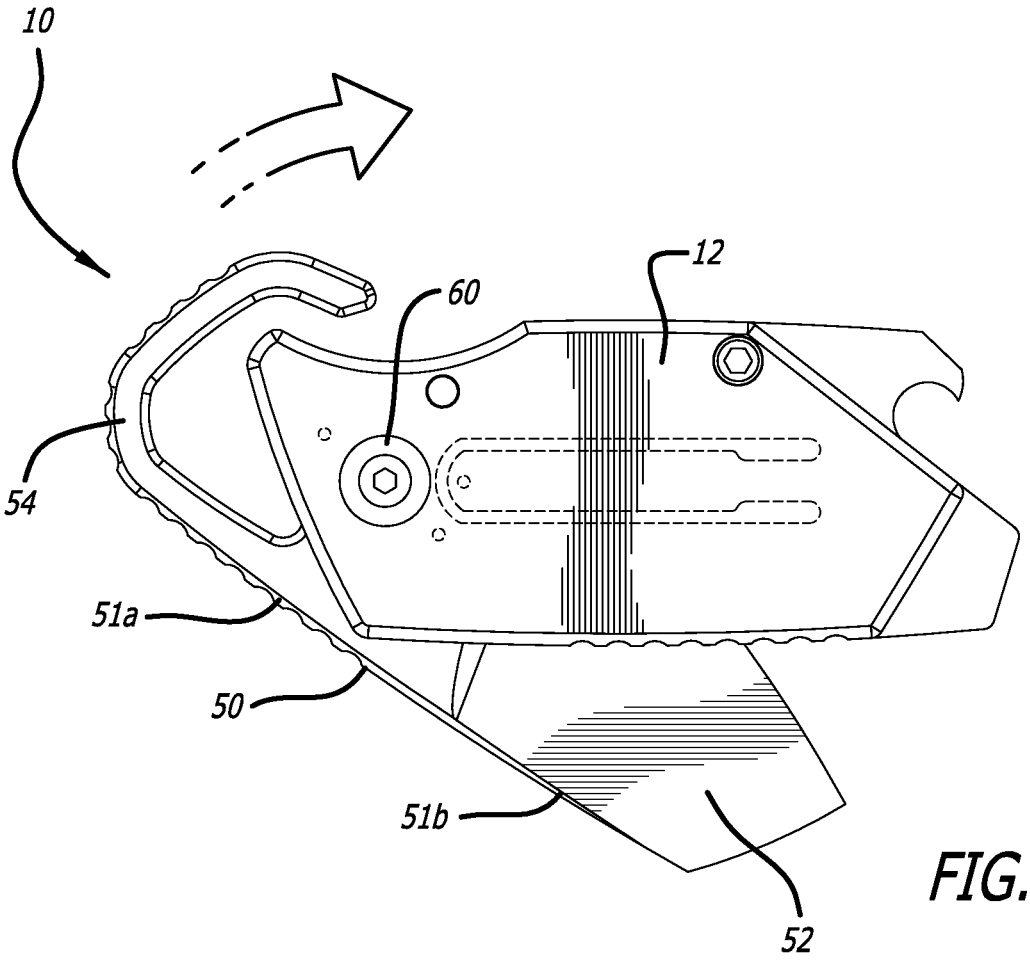
FIG. 4

MULTIFUNCTION FOLDABLE KNIFE

CLAIM OF PRIORITY

The present application for patent claims priority to U.S. Provisional Application No. 62/727,428 entitled "Multifunction Foldable Knife", filed Sep. 5, 2018, which is hereby expressly incorporated by reference.

TECHNICAL FIELD

The present disclosure relates to knives. The present disclosure has particular applicability as a utility knife.

BACKGROUND

Typically a utility knife includes a handle and a knife blade either rotatably or slidably engaged with the handle. Some of the utility knives may further include a knob secured to the knife blade for moving the knife blade inward and outward of the handle. These knives have a pair of handle members generally joined at a median plane which are held together by a releasable fastener such that a blade is clamped between the halves in a cutting position. The two halves are typically held together with a bolt and a nut which requires the use of a screwdriver or like instrument for separating the two halves of the handle.

To avoid the danger of an exposed blade when the utility knife is not in use, some prior art utility knives include arrangements in which the blade is self-retractable into the handle. However, such prior art utility knives can be difficult to maintain a constant extension of the blade and are generally not compact nor do they include a latching mechanism for easy attachment to a belt or case.

Thus, there is a need to overcome the drawbacks or disadvantages of the prior art.

SUMMARY

To overcome the disadvantages discussed above, the present application is directed to a multifunction utility knife that allows for easy handling and enclosure of the blade and a hook to attach the knife to an object for storage and easy access.

The foldable knife includes a handle with a first half handle and a second half handle, the handle having a blade containing portion for securing a substantially flat blade and an opening in the handle on a top surface and a first and second end to contain the flat blade in a folded closed position, a bottom surface of the handle being closed. The foldable knife further includes a hook portion on a posterior end of the flat blade and a cutting surface portion on an anterior end of the flat blade and a nut and bolt system passing through the flat blade near the posterior end of the flat blade and further through the first and second half handle terminating at on outside portion of each of the first and second half handles enabling the flat blade to rotate between an open position and a closed position, in the closed position the hook portion is exposed enabling the foldable knife to be attached to an object. A spring bar is integrated in the first half handle in a central portion of the first half handle including a space on three sides of the spring bar, attached to the first half handle at a posterior end of the spring bar and including a detent ball on an anterior end of the spring bar, the detent ball enabled to engage the flat blade in various position to lock the flat blade in the various positions.

DRAWINGS

The following figures set forth embodiments of the invention in which like reference numerals denote like parts. Embodiments of the invention are illustrated by way of example and not by way of limitation in the accompanying figures.

FIG. 3 is side view of the foldable knife of an embodiment of the present disclosure in a closed position;

FIG. 4 is side view of the foldable knife of an embodiment of the present disclosure in an opening position;

DETAILED DESCRIPTION

The description set forth below in connection with the appended drawings is intended as a description of various configurations and is not intended to represent the only configurations in which the concepts and features described herein may be practiced. The following description includes specific details for the purpose of providing a thorough understanding of various concepts. However, it will be apparent to those skilled in the art that these concepts may be practiced without these specific details. In some instances, well known, structures, techniques and components are shown in block diagram form to avoid obscuring the described concepts and features.

Figure 1:
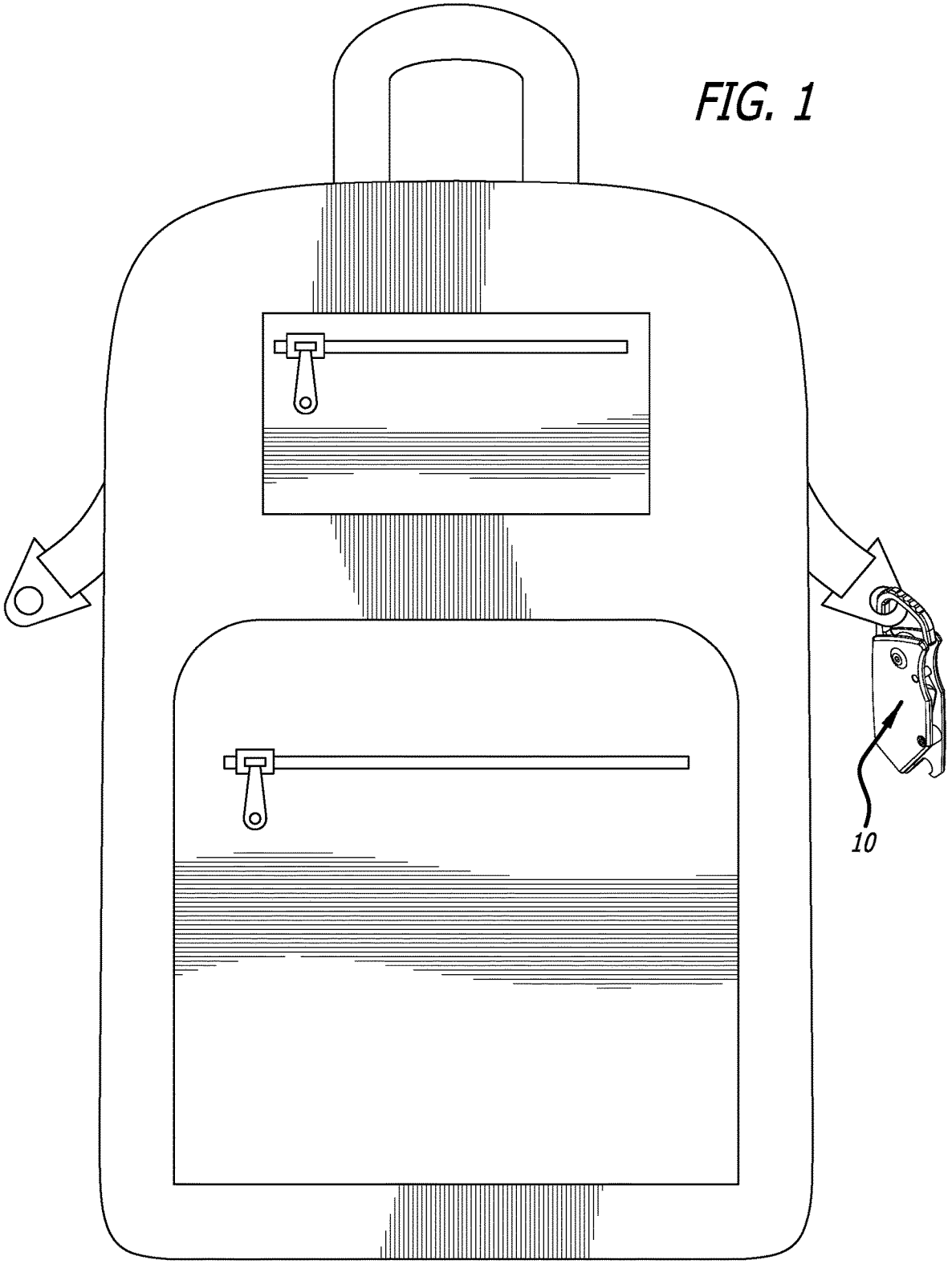
FIG. 1 is a front perspective view of a foldable knife of an embodiment of the present disclosure attached to a backpack strap.

A foldable knife 10 that can be advantageously secured to a belt or backpack as shown in FIG. 1 according to an embodiment of the present disclosure will now be described with reference to the drawings.

Figure 2:
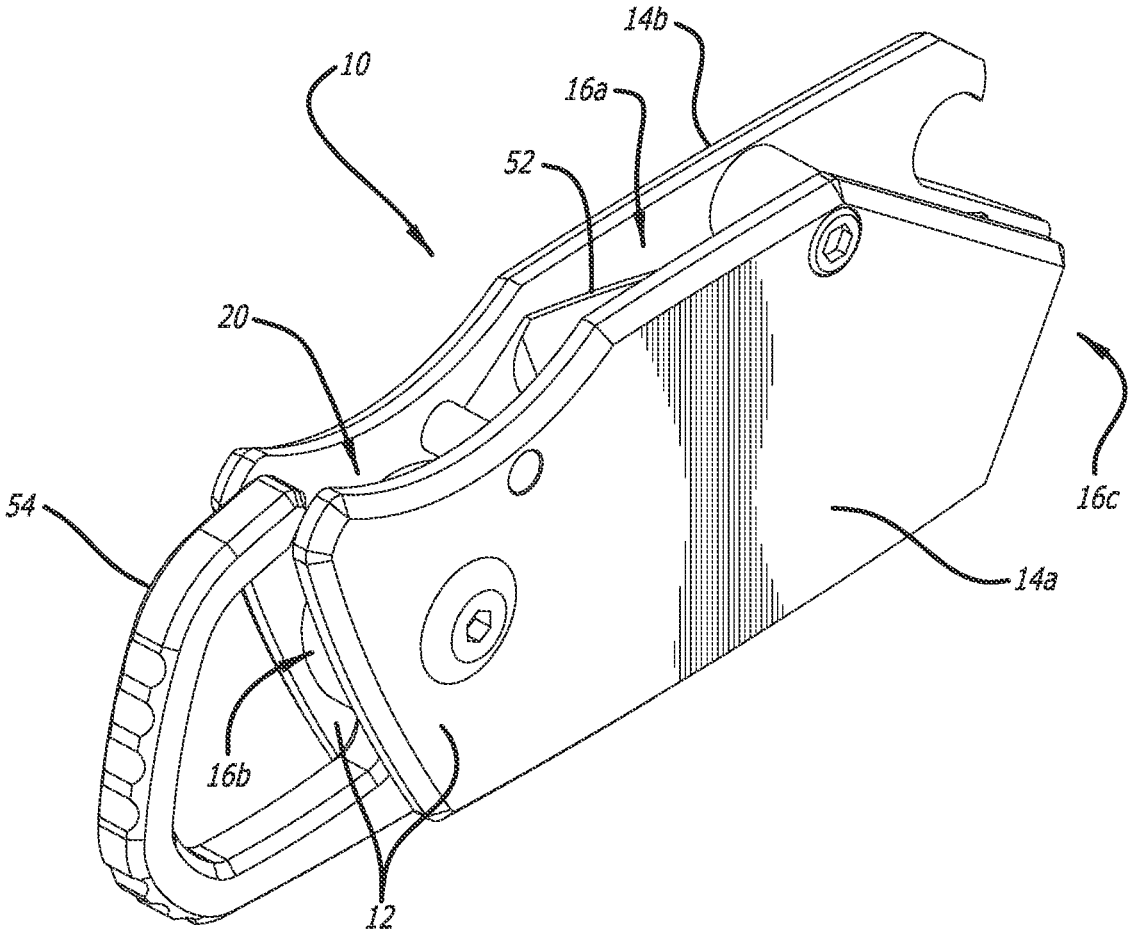
FIG. 2 is a perspective view of the foldable knife of an embodiment of the present disclosure.

FIG. 2 shows a folding knife 10 comprised of a handle 12 with a first half 14*a* and a second half 14*b*, having a blade containing portion 20 for folding a substantially flat blade 50, an opening for the blade containing portion 20 in the handle 12 on a top surface 16*a* and a first end 16*b* and second end 16*c* to contain the flat blade 50 in a folded closed position for securing a cutting surface portion 52 of the flat blade 50 in the blade containing portion 20, and a hook portion 54 of the flat blade for attaching the foldable knife to an object such as a belt or a backpack as in FIG. 1.

Figure 5:
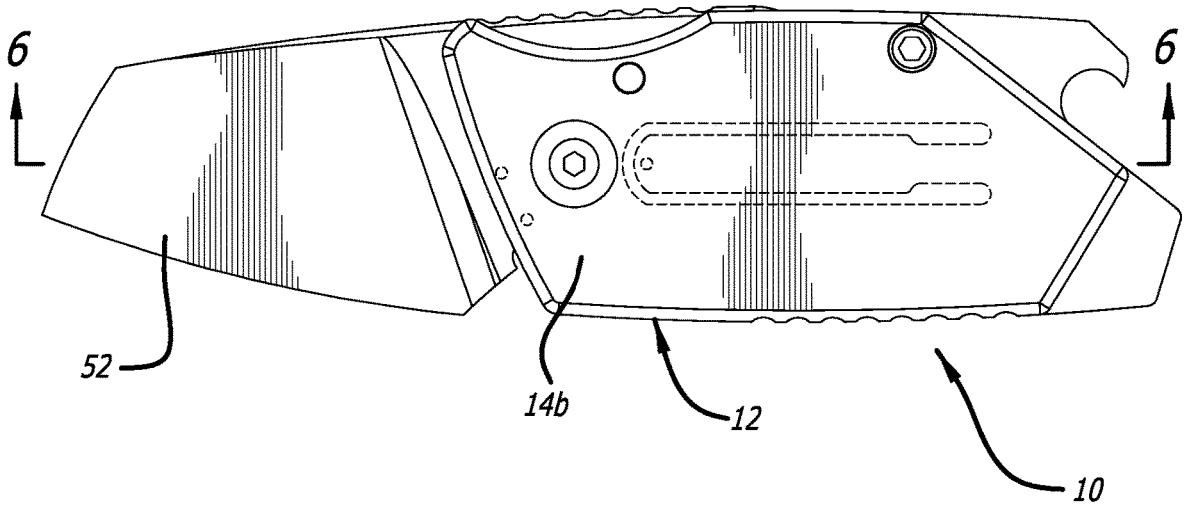
FIG. 5 is a side view of the foldable knife of an embodiment of the present disclosure in an opened position.

Now referring to FIGS. 3-5, the flat blade 50 additionally comprises at least the hook portion 54 on a posterior end 51*a* of the flat blade 50 and the cutting surface portion 52 on an anterior end 51*b* of the flat blade 50. Additionally, a post and cap system 60 passes through the flat blade 50 near the posterior end 51*a* of the flat blade 50 and further through the first 14*a* and second half 14*b* of the handle 12 terminating at on outside portion of each of the first 14*a* and second half handles 14*b* (FIG. 9) enabling the flat blade 50 to rotate, as shown by the arrows in FIGS. 3-4, between an open position (FIG. 5) and a closed position (FIGS. 2-3). The outer edge of each of the first 14*a* and second 14*b* half handles is beveled and a portion of the top surface includes a curved indented edge.

For example, as the flat blade 50 is rotated around a post 62 (See FIG. 9) of the post and cap system 60 as in FIG. 4, the hook portion 54 is exposed enabling the foldable knife 10 to be attached to an object such as shown in FIG. 1. The flat blade 50 continues to be rotated to a closed position as in FIG. 3, thus closing the loop of the hook portion 54 and securing the foldable knife 10 to the object by the hook portion 54 being engaged within the opening of the blade containing portion 20. According to one embodiment, the hook portion may function like a carabiner.

In addition, as shown in FIG. 5, the first half handle 14*a* or scale (FIG. 2) and second half handle 14*b*, or scale, include a ridged surface on a bottom edge of each half of handle 12 for easy grip by a user.

Figure 9:
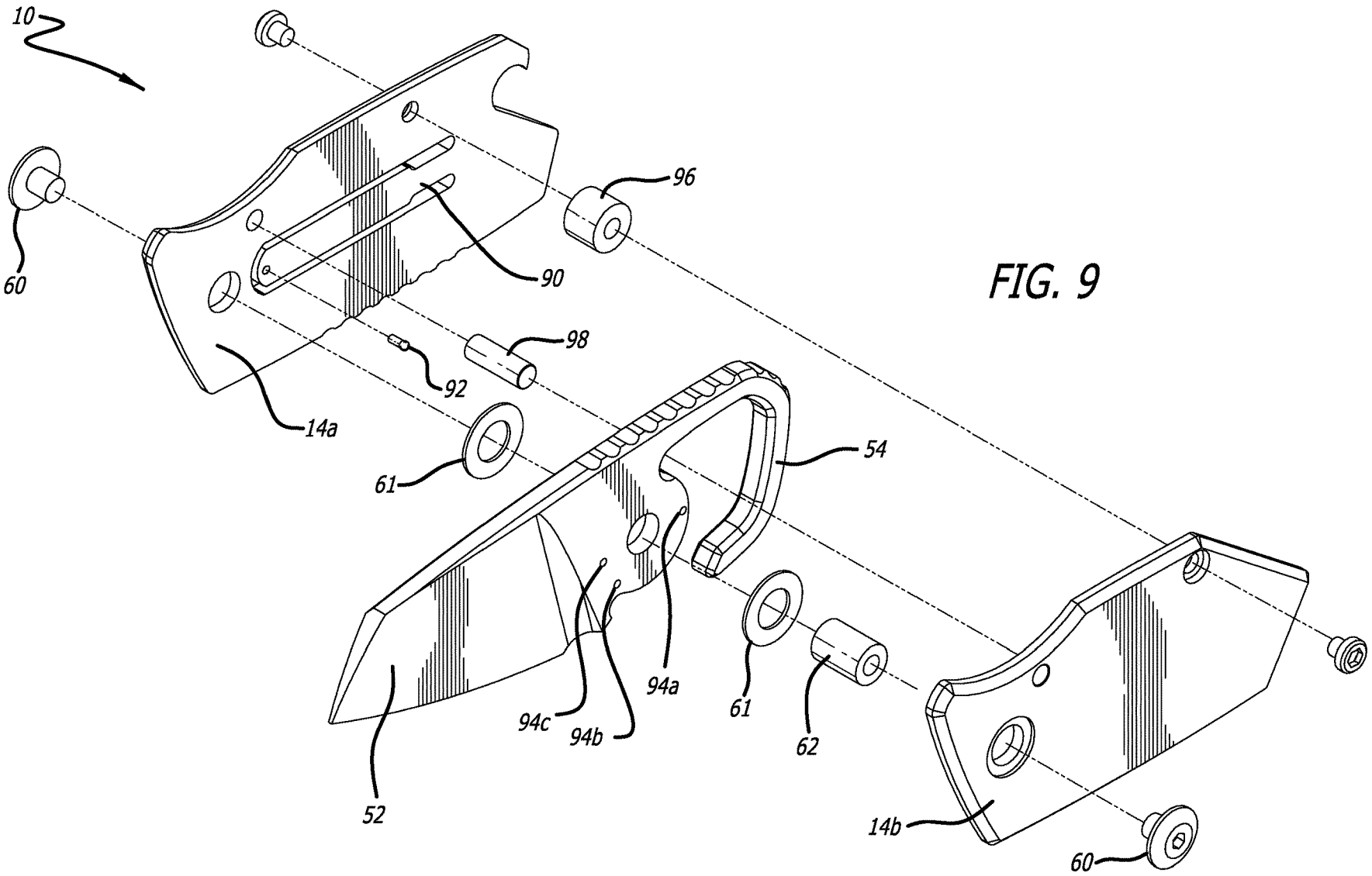
FIG. 9 is an exploded assembly view of the internal components of the foldable knife in an embodiment of the present disclosure.

As most readily seen in FIG. 9, the handle 12 includes the first half handle 14*a*, or scale, which further includes a spring bar 90. The spring bar 90 may be integrated in a central portion of the first half handle 14*a*, or scale, having a space on three sides of the spring bar 90, attached to the first half handle 14*a*, or scale, at a posterior end of the spring bar 90 and including a ball pin (or detent ball) 92 on an anterior end of the spring bar, the ball pin (or detent ball) enabled to engage the flat blade 50 in various positions to lock the flat blade in the various positions.

The ball pin (or detent ball) 92 of the spring bar 90 is enabled to engage into the holes 94*a*, 94*b*, 94*c* of the flat blade 50. The spring bar 90 is cut into the first half handle 14*a*, or scale, such that it is able to bend slightly in an outward direction to allow the ball of the ball pin (or detent ball) 92 to fit into one of the holes 94*a-c* allowing the flat blade 50 to lock into one of the positions set by the holes 94*a-c* to securely hold the flat blade 50 in one of the three set positions. For example, hole 94*a* secures the flat blade 50 in the opened position with the cutting surface portion 52 fully extended (See FIG. 5). Hole 94*b* secures the flat blade 50 in a partially opened position to allow the hook portion 54 to hook onto an object (See FIG. 4). Hole 94*c* secures the flat blade 50 in a closed position (See FIG. 3). The partially opened position (See FIG. 4) allows the hook portion 54 to hook onto the object. When the flat blade 50 is moved to the closed position (See FIG. 3), the hook portion 54 is securely attached to the object.

FIG. 9 further shows a pin 98 of the knife 10. When the knife is in an assembled position, the pin 98 extends between a first hole on the first half handle 14*a*, or scale, and a second hole on the second half handle 14*b* and fits or extends within recesses of the flat blade 50. As the flat blade 50 moves between the open and closed positions, the pin 98 follows the curvilinear portions of the flat blade 50 which is integrally formed into the cutting surface portion 52 and located between the posterior and anterior ends of the flat blade 50. Additionally, as shown in FIG. 9, washers 61 may be located between the blade 52 and each scale (i.e. the first half handle 14*a* and the second half handle 14*b*).

Figure 6:
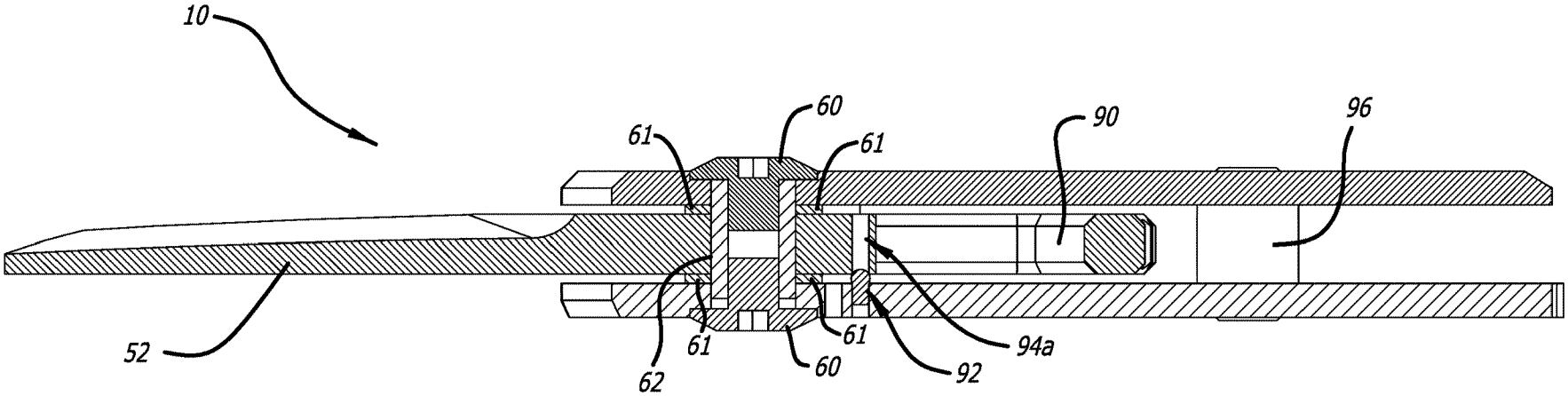
FIG. 6 is a cross-sectional view foldable knife taken along line 6-6 in FIG. 5.

FIG. 6 is a cross-sectional view foldable knife 10 taken along line 6-6 in FIG. 5. The cross-sectional view shows the internal structure and/or features of the foldable knife 10 including the engaged ball pin (or detent ball) 92. As shown, the cutting surface portion 52 of the flat blade 50 is extended in the open position. The post and cap system 60 is shown through the first half handle 14*a*, or scale, through a hole in the flat blade 50 and further through the second half handle 14*b*, or scale. Engaged ball pin (or detent ball) 92 is secured in hole 94*a* being attached to the spring bar 90.

Figure 7:
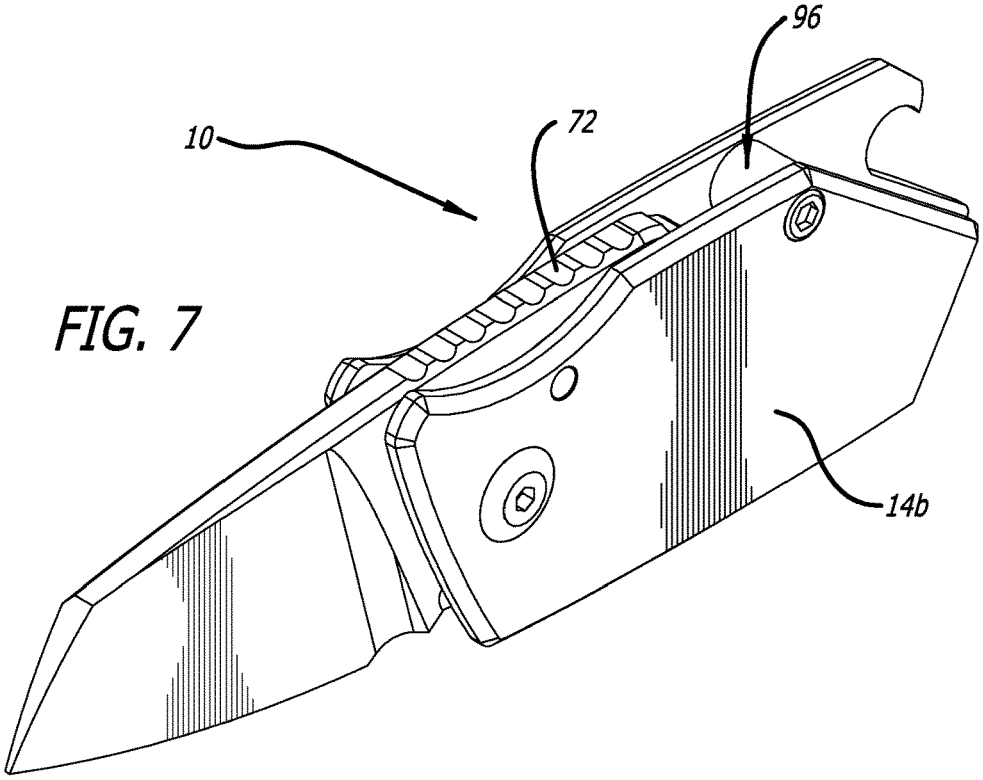
FIG. 7 is a perspective view of the foldable knife of an embodiment of the present disclosure with the knife in an opened position.
Figure 8:
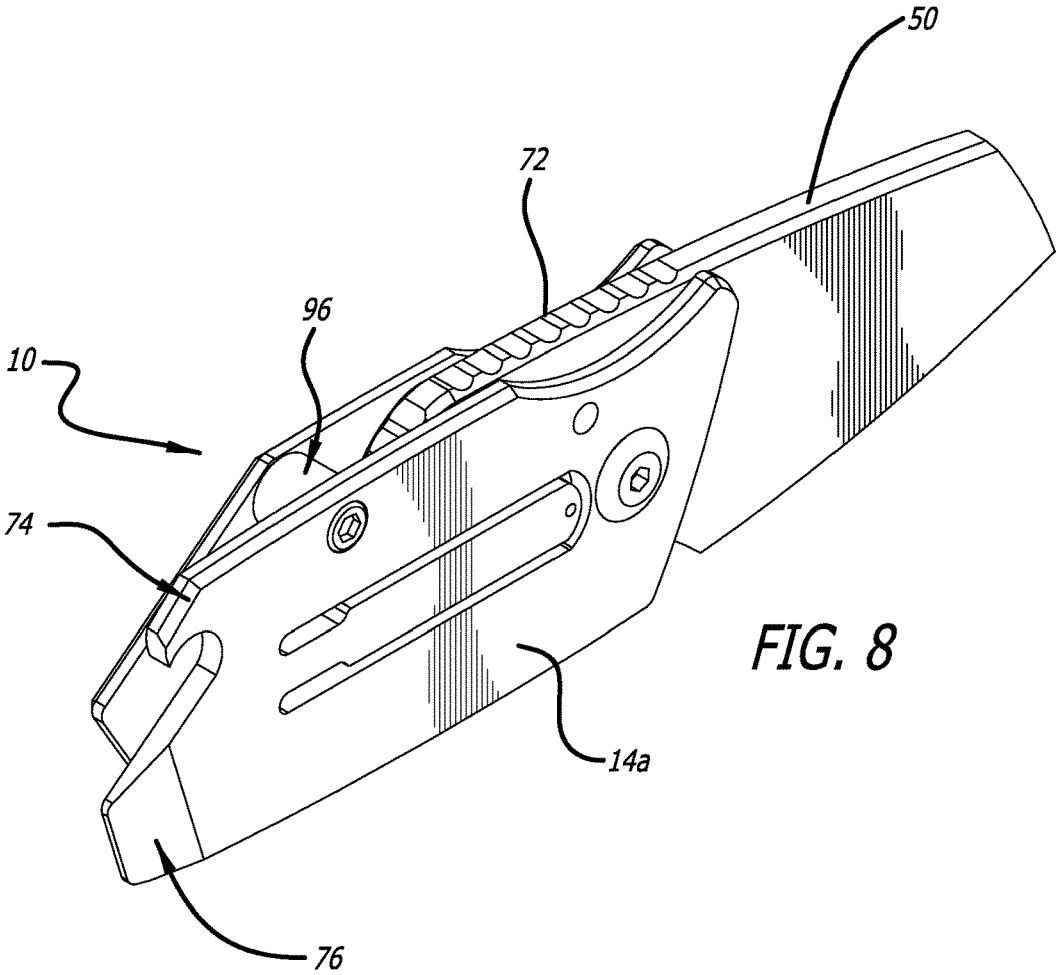
FIG. 8 is another perspective view of the foldable knife of an embodiment of the present disclosure with the knife in an opened position.

Referring now to FIGS. 7-8, a retainer post 96 maintains the first half handle 14*a*, or scale, and the second half handle 14*b*, or scale, parallel to each other. FIGS. 7-8 provide perspective views of each side of the foldable knife of an embodiment of the present disclosure with the knife in an opened position. Also shown in FIGS. 7-8 is a ridged portion 72 of the flat blade 50 to provide a secure handle for the user. The first half handle 14*a*, or scale, as shown in FIG. 8 and second half handle 14*b*, or scale, as shown in FIG. 7 are beveled.

As shown in FIG. 8, the foldable knife 10 further includes a can opener tool 74 and a flat head screwdriver tool 76 to add further utility to the foldable knife 10.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

I claim:

1. A foldable knife comprising:

a handle including a first half handle and a second half handle, the second half handle having an upper flat surface and an opposing lower flat surface, a first end portion extending outwardly from the upper flat surface and a second end portion extending outwardly from the lower flat surface, where the first and second end portions creating a notch in a handle posterior end;

a blade containing portion, in the handle, including an opening on a top surface and a first and second end to contain a flat blade in a folded closed position, a bottom surface of the handle being closed;

a hook portion integrally formed on a posterior end of the flat blade;

a cutting surface portion on an anterior end of the flat blade;

a post and cap system passing through the flat blade near the posterior end of the flat blade and further through the first and second half handles terminating at on outside portion of each of the first and second half handles enabling the flat blade to rotate, relative to the first and second half handles, between an open position, a partially open position and a closed position, in the open position the hook portion is concealed, in the partially open position the hook portion is exposed enabling the knife to be attached to an object and in the closed position a distal end of the hook portion is concealed disabling the hook portion from functioning as a carabiner; and a spring bar integrated in a central portion of the first half handle having a space on three sides of the spring bar, attached to the first half handle at a posterior end of the spring bar and including a ball pin on an anterior end of the spring bar, the ball pin enabled to engage the flat blade in various positions to lock the flat blade in the various positions.

2. The foldable knife of claim 1, further comprising three holes in the flat blade portion, the three holes mate with the ball pin to enable the flat blade to lock into one of three positions.

3. The foldable knife of claim 2, wherein the three positions include the open position exposing the cutting surface portion, the closed position exposing the hook and a partially open position exposing both the cutting surface portion and the hook portion.

4. The foldable blade of claim 3, wherein in the closed position an end of the hook portion fits within the opening of the handle causing the hook portion to be closed.

5. The foldable knife of claim 1, wherein the bottom surface of the first and second half handles include a ridged portion at an anterior end of the first and second half handles, and the top surface of the first and second half handles includes a smooth surface.

6. The foldable knife of claim 5, wherein a portion of the top surface of the first and second half handles is indented.

7. The foldable knife of claim 1, wherein the hook portion includes a ridged surface along an outer edge of the hook portion.

8. The foldable knife of claim 1, wherein the cutting surface portion fits entirely within the handle in the closed position.

9. The foldable knife of claim 1, wherein an outer edge of the handle is beveled.

10. The foldable knife of claim 1, wherein the notch forms a can opener.

11. The foldable knife of claim 1, wherein the second end portion operates as a screwdriver.

12. The foldable knife of claim 1, wherein the hook portion has a first end integrally formed on a posterior end of the flat blade and the distal end detached from the flat blade.

13. A foldable knife comprising:

a folding handle including a first half handle and a second half handle, the second half handle having an upper flat surface and an opposing lower flat surface, a first end portion extending outwardly from the upper flat surface and a second end portion extending outwardly from the lower flat surface, where the first and second end portions creating a notch in a handle posterior end forming a can opener;

a blade containing portion in the handle including an opening on a top surface and a first and second end to contain a flat blade in a folded closed position, a bottom surface of the handle being closed;

a hook portion on a posterior end of the flat blade and a cutting surface portion on an anterior end of the flat blade, the hook portion for attaching the folding knife to an object; and a post and cap system passing through the flat blade near the posterior end of the flat blade and further through the first and second half handle terminating at on outside portion of each of the first and second half handles enabling the flat blade to rotate, relative to the first and second half handles, between an open position, a partially open position and a closed position, in the open position the hook portion is concealed, in the partially open position the hook portion is exposed enabling the knife to be attached to the object and in the closed position a distal end of the hook portion is concealed disabling the hook portion from functioning as a carabiner.

14. The foldable knife of claim 13, further comprising:

a spring bar integrated in a central portion of the first half handle having a space on three sides of the spring bar, attached to the first half handle at a posterior end of the spring bar and including a ball pin on an anterior end of the spring bar, the ball pin enabled to engage the flat blade in various positions to lock the flat blade in the various positions.

15. The foldable knife of claim 14, further comprising three holes in the flat blade portion, the three holes mate with the pin ball to enable the flat blade to lock into one of three positions.

16. The foldable knife of claim 15, wherein the three positions include the open position exposing the cutting surface portion, the closed position exposing the hook and a partially open position exposing both the cutting surface portion and the hook portion.

17. The foldable knife of claim 16, wherein in the closed position an end of the hook portion fits within the opening of the handle causing the hook portion to be closed retaining the folding knife to the object.

18. A foldable knife comprising:

a handle including a first half handle and a second half handle, the second half handle having an upper flat surface and an opposing lower flat surface, a first end portion extending outwardly from the upper flat surface and a second end portion extending outwardly from the lower flat surface, where the first and second end portions creating a notch in a handle posterior end forming a can opener;

a blade containing portion in the handle including an opening on a top surface and a first and second end to contain a flat blade in a folded closed position, a bottom surface of the handle being closed;

a hook portion on a posterior end of the flat blade and a cutting surface portion on an anterior end of the flat blade, the hook portion for attaching the folding knife to an object;

a post and cap system passing through the flat blade near the posterior end of the flat blade and further through the first and second half handle terminating at on outside portion of each of the first and second half handles enabling the flat blade to rotate, relative to the first and second half handles, between an open position, a partially open position and a closed position, in the open position the hook portion is concealed, in the partially open position a distal end of the hook portion is exposed enabling the knife to be attached to the object and in the closed position the hook portion is concealed disabling the hook portion from functioning as a carabiner;

a spring bar integrated in a central portion of the first half handle having a space on three sides of the spring bar, attached to the first half handle at a posterior end of the spring bar and including a ball pin on an anterior end of the spring bar, the ball pin enabled to engage the flat blade in various positions to lock the flat blade in the various positions, and three holes in the flat blade portion, the three holes mate with the pin ball to enable the flat blade to lock into one of three positions.

19. The foldable knife of claim 18, wherein in the closed position an end of the hook portion fits within the opening of the handle causing the hook portion to be closed retaining the folding knife to the object.

* * * * *